US006209725B1

(12) United States Patent
Chen

(10) Patent No.: US 6,209,725 B1
(45) Date of Patent: Apr. 3, 2001

(54) EXPANDABLE BASKET FOR HOLDING ARTICLES

(76) Inventor: Shui-Shang Chen, 199, Su Mou rd., Ho Mei Township, Chan Hua Hsien (TW)

( * ) Notice: Subject to any disclaimer, the term of this patent is extended or adjusted under 35 U.S.C. 154(b) by 0 days.

(21) Appl. No.: 09/536,851

(22) Filed: Mar. 28, 2000

(51) Int. Cl.[7] ..... B65D 21/036
(52) U.S. Cl. ..... 206/508; 220/23.88; 220/23.89
(58) Field of Search ..... 26/508, 509; 220/23.88, 220/23.89, 23.86

(56) References Cited

U.S. PATENT DOCUMENTS 3,913,788 * 10/1975 Pattgrshall ..... 206/508
4,420,093 * 12/1983 Von Holdt ..... 206/508
4,421,244 * 12/1983 Van Melle ..... 206/508
5,035,324 * 7/1991 Bertrand ..... 206/508
5,083,674 * 1/1992 Clarke ..... 206/508
5,211,289 * 5/1993 Matthews ..... 206/508
5,259,509 * 11/1993 Boal, Jr. et al. ..... 206/508
5,738,209 * 4/1998 Burr et al. ..... 206/508
5,896,993 * 4/1999 Nask et al. ..... 206/508
6,095,333 * 8/2000 Bertrand ..... 206/508

* cited by examiner

*Primary Examiner*—Joseph M. Moy
(74) *Attorney, Agent, or Firm*—Harrison & Egbert

(57) ABSTRACT

An expandable basket is formed of a main body, a top box, a cover, and a handle. The top box is disposed on the top of the main body and is provided with an expandable cylinder. The main body is provided in the underside thereof with a retaining portion. The cover is provided in the top thereof with a retaining portion engageable with the retaining portion of the main body of another basket. A plurality of baskets can be thus arranged together.

3 Claims, 8 Drawing Sheets

EXPANDABLE BASKET FOR HOLDING ARTICLES

FIELD OF THE INVENTION

The present invention relates generally to a basket for holding articles, and more particularly to an expandable basket for holding articles.

BACKGROUND ART

As shown in FIG. 1, a prior art basket 10 has a main body 11 which is provided therein with a plurality of spaces 13 formed and defined by a plurality of partitions 12. The main body 11 has an open top which is provided with a cover 14. The main body 11 is provided with a handle 15 fastened therewith. The spaces 13 are intended to hold a variety of articles.

SUMMARY OF THE INVENTION

The primary objective of the present invention is to provide a basket expandable to give an additional space to hold articles.

It is another objective of the present invention to provide a modular basket formed of units of standardized size and form, which can be fitted together end to end.

The objectives, features, and advantages of the present invention will be readily understood upon a thoughtful deliberation of the following detailed description of the present invention with reference to the accompanying drawings.

DETAILED DESCRIPTION OF THE INVENTION

Figure 1:
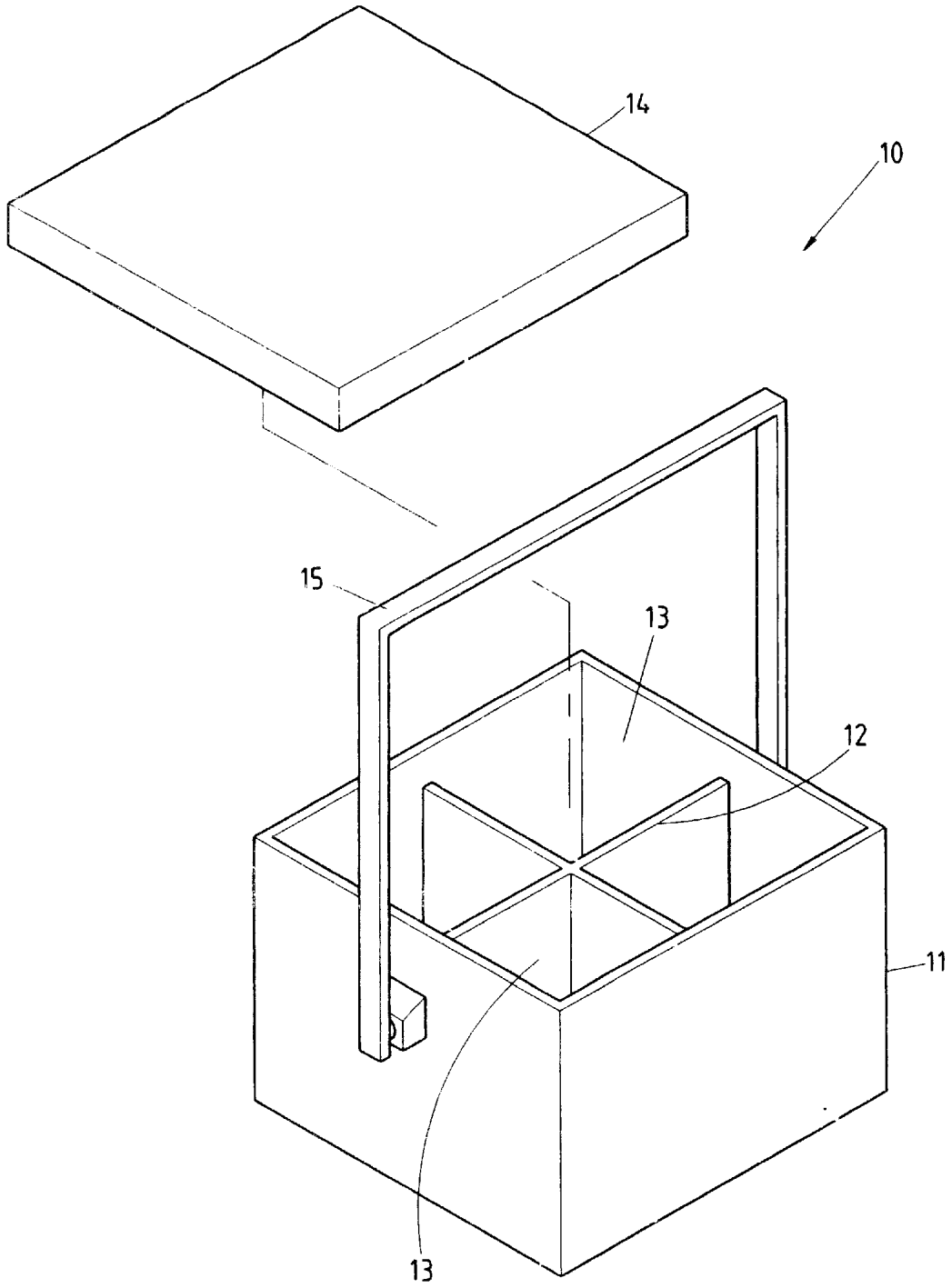
FIG.1 PRIOR ART
FIG. 1 shows a perspective view of a prior art basket.
Figure 2:
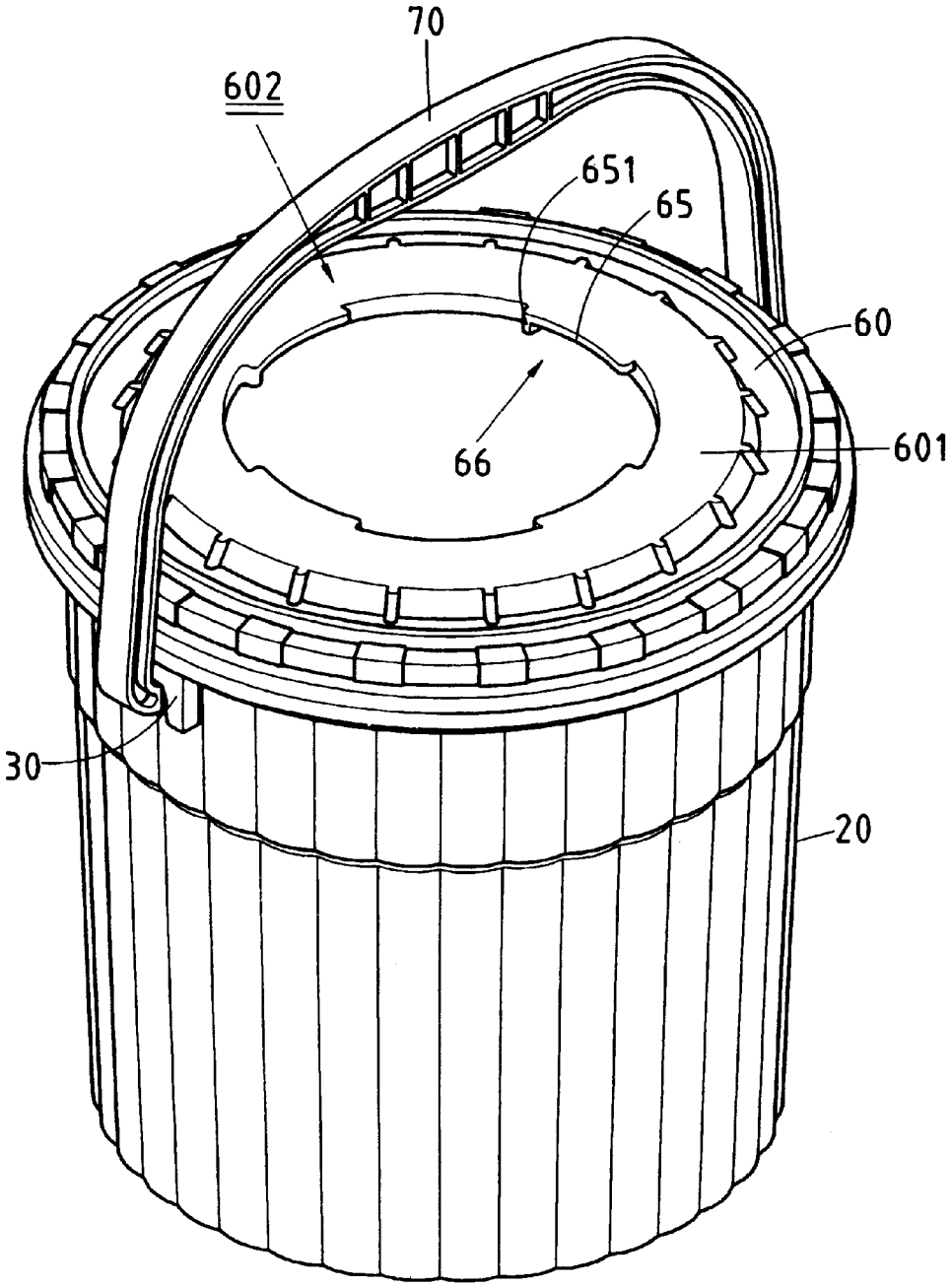
FIG. 2 shows a perspective view of the present invention.
Figure 3:
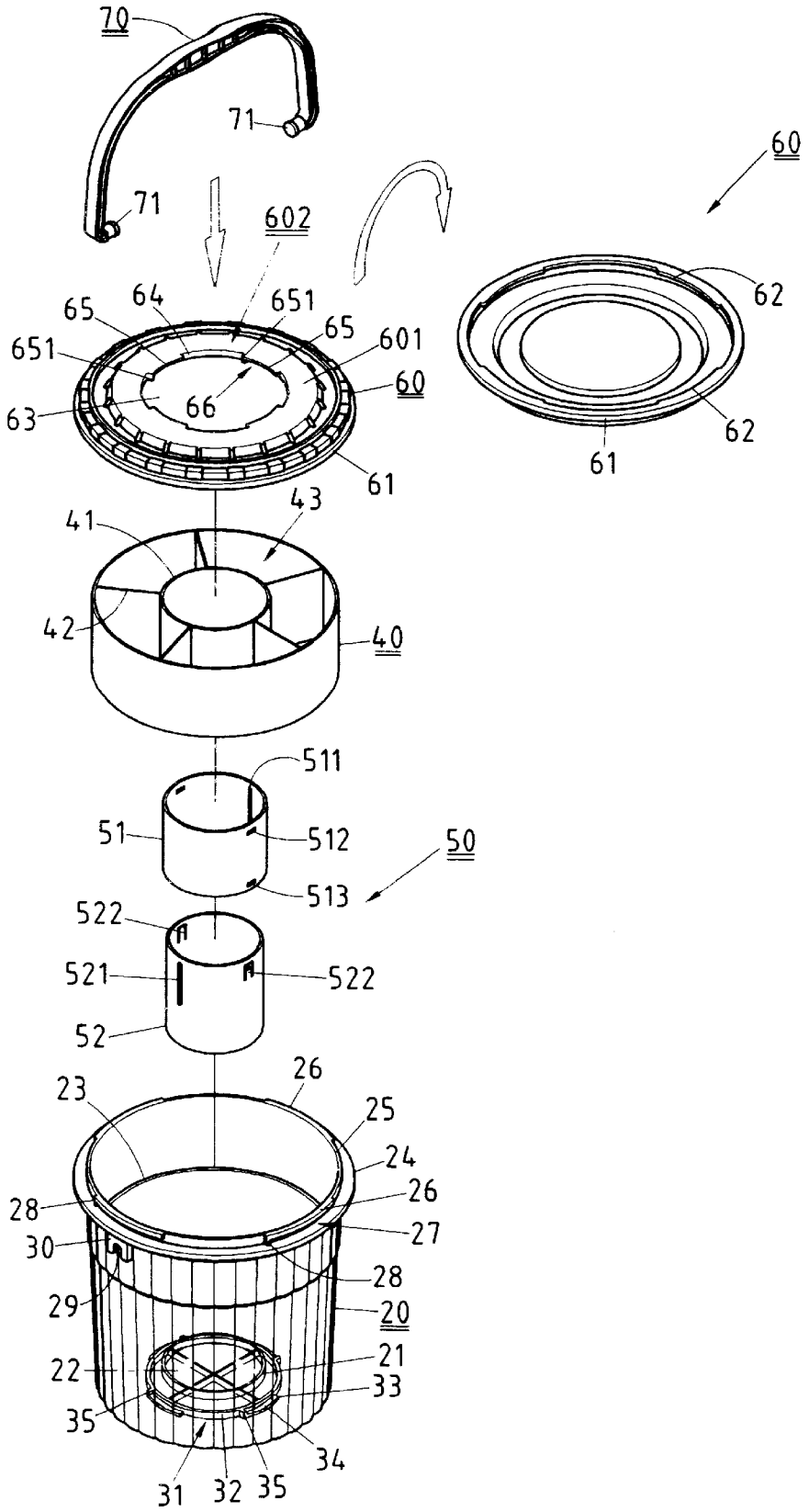
FIG. 3 shows an exploded view of the present invention.
Figure 4:
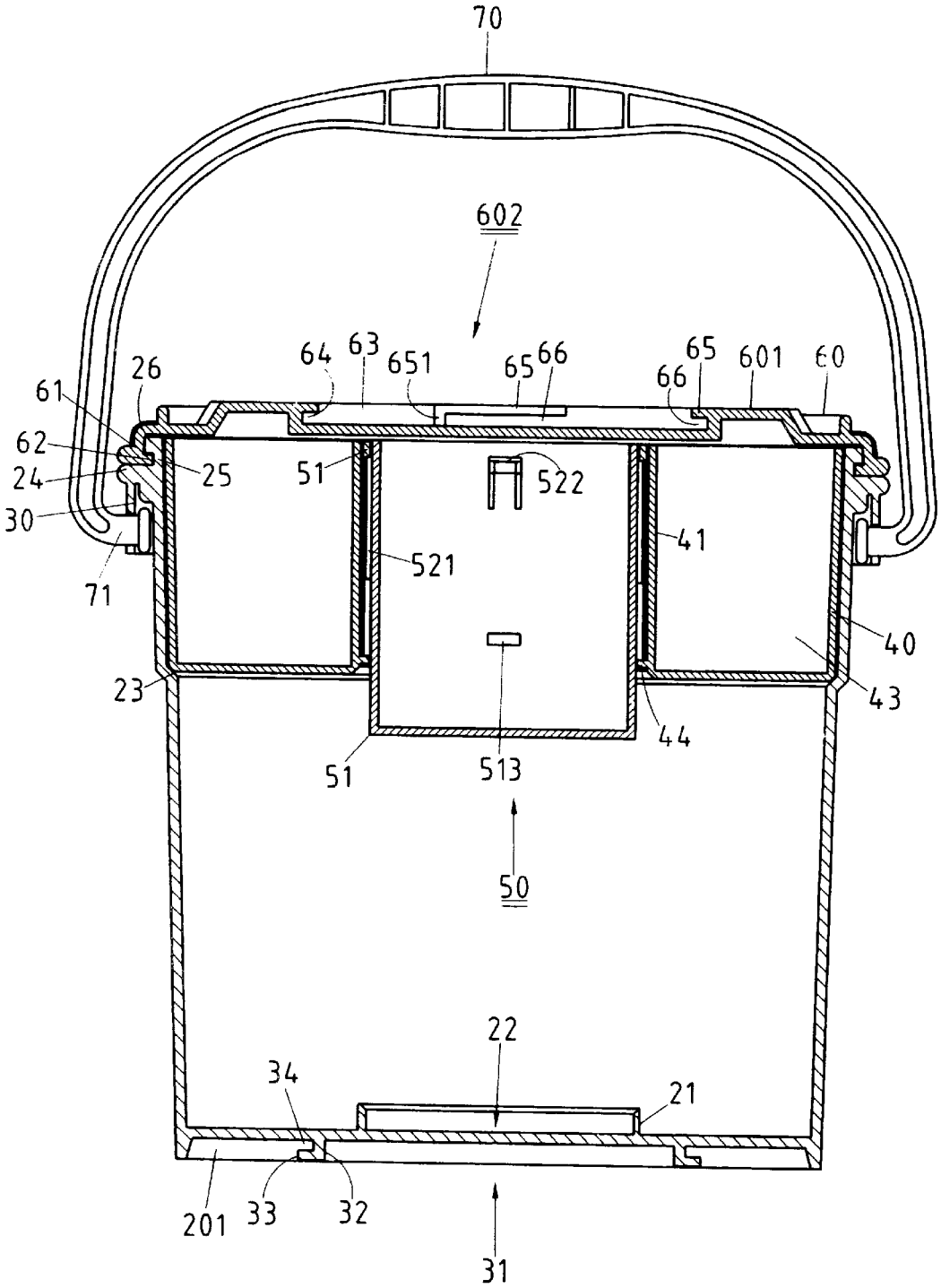
FIG. 4 shows a longitudinal sectional view of the present invention.
Figure 5:
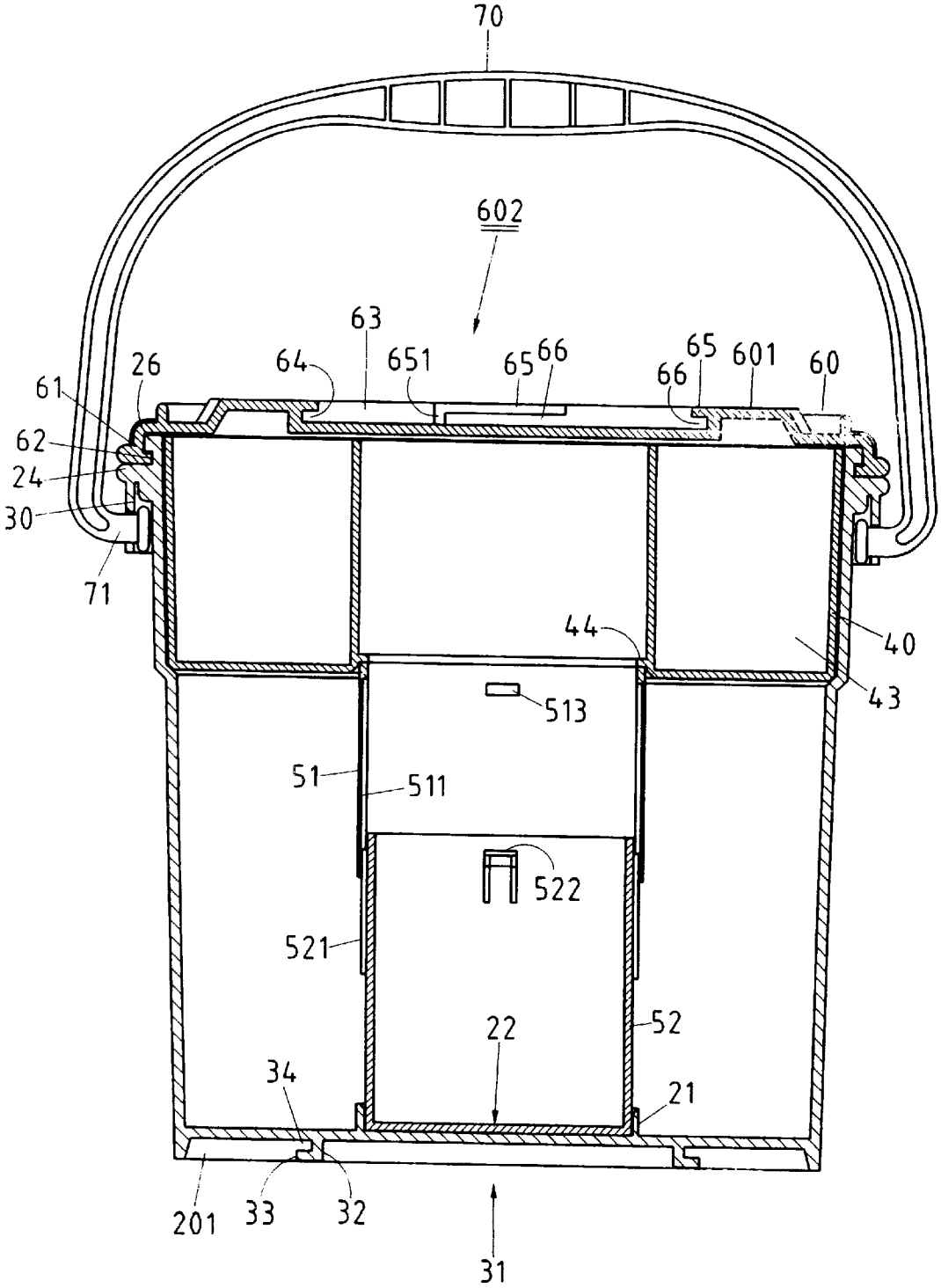
FIG. 5 shows a longitudinal sectional view of an expanded basket of the present invention.

As shown in FIGS. 2–5, a basket embodied in the present invention is intended to hold a variety of articles and is formed of a hollow main body 20, a top box 40, a cover 60, and a handle 70.

The main body 20 is provided in the bottom thereof with an annular protrusion 21 and an annular slot 22 defined by the annular protrusion 21. The hollow main body 20 is provided in the inner wall of the top portion thereof with an annular stop edge 23, and in the outer wall of the top portion thereof with an outer flange 24 and an inner flange 25 which is provided with a plurality of retaining strips 26 separated from one another and from the outer flange 24 by a space 27. Each of the retaining strips 26 is provided at one and thereof with a stop body 28 which is connected to the top of the outer flange 24. The main body 20 is further provided in the outer wall thereof with two protuberances 30, with each having an opening 29.

The top box 40 is provided in the center thereof with a cylindrical body 41. Located between the outer wall of the cylindrical body 41 and the inner wall of the top box 40 are a plurality of cells 43 which are formed and defined by the pieces 42. The top box 40 is disposed in the top portion of the main body 20 such that bottom edge of the top box 40 is stopped by the annular stop edge 23 of the main body 20.

The cover 60 is provided in the outer periphery thereof with an annular wall 61 which is in turn provided with a plurality of retaining bodies 62 separated from one another. The cover 60 is rotatably joined with the top edge of the main body 20 such that the retaining bodies 62 are retained in the spaces 27.

The handle 70 is provided respectively at both ends thereof with a retaining pillar 71 and is fastened at both ends thereof to the main body 20 such that the retaining pillar 71 of each end of the handle 70 is retained in the opening 29 of the protuberance 30.

The present invention is characterized by the main body 20 which is provided in the underside thereof with a recess 201 and a retaining portion 31 which is provided with a bottom ring 32 and a plurality of bottom strips 33 separated from one another. The retaining portion 31 is separated from the underside of the main body 20 by an appropriate distance 34. Each of the bottom strips 33 is provided at one end thereof with an arresting body 35 which is connected with the underside of the main body 20.

The present invention is further characterized by the cover 60 which is provided with an annular seat 601 and a retaining portion 602. The cover 60 has a round slot 63 and an inner wall 64 which is provided with a plurality of retaining edges 65 and spaces 66 which are formed between the underside of the retaining edges 65 and the underside of the round slot 63. Each retaining edge 65 is provided at one end thereof with a stop block 651 which is connected to the underside of the round slot 63. The retaining portion 31 of another main body 20 is retained in the round slot 63 of the retaining portion 602 of the cover 60 such that the bottom strips 33 of the retaining portion 31 are retained in the spaces 66 of the cover 60.

The cylindrical body 41 is further provided in the inner wall of the bottom portion thereof with an annular body 44 to accommodate an expandable cylinder 50, which is formed of an outer cylinder 51 and an inner cylinder 52. The outer cylinder 51 is dimensioned to be received in the interior of the cylindrical body 41 such that the outer wall of the outer cylinder 51 is in contact with the inner wall of the cylindrical body 41. The outer cylinder 51 is provided in the inner wall thereof with two longitudinal slots 511 opposite to each other. The outer cylinder 51 is further provided with an upper retaining hole 512 and a lower retaining hole 513. The inner cylinder 52 has a closed bottom and is provided in the outer wall thereof with two longitudinally-oriented guide strips 521, and two elastic retaining hooks 522 which are located in the proximity of the top of the inner cylinder 52. The inner cylinder 52 is received in the outer cylinder 51 such that the guide strips 521 of the inner cylinder 52 are received in the longitudinal slots 511 of the inner wall of the outer cylinder 51. As the inner cylinder 52 is displaced in the outer cylinder 51, the elastic retaining hooks 522 of the inner cylinder 52 are retained in the upper retaining hole 512 and the lower retaining hole 513 of the outer cylinder 51.

Figure 6:
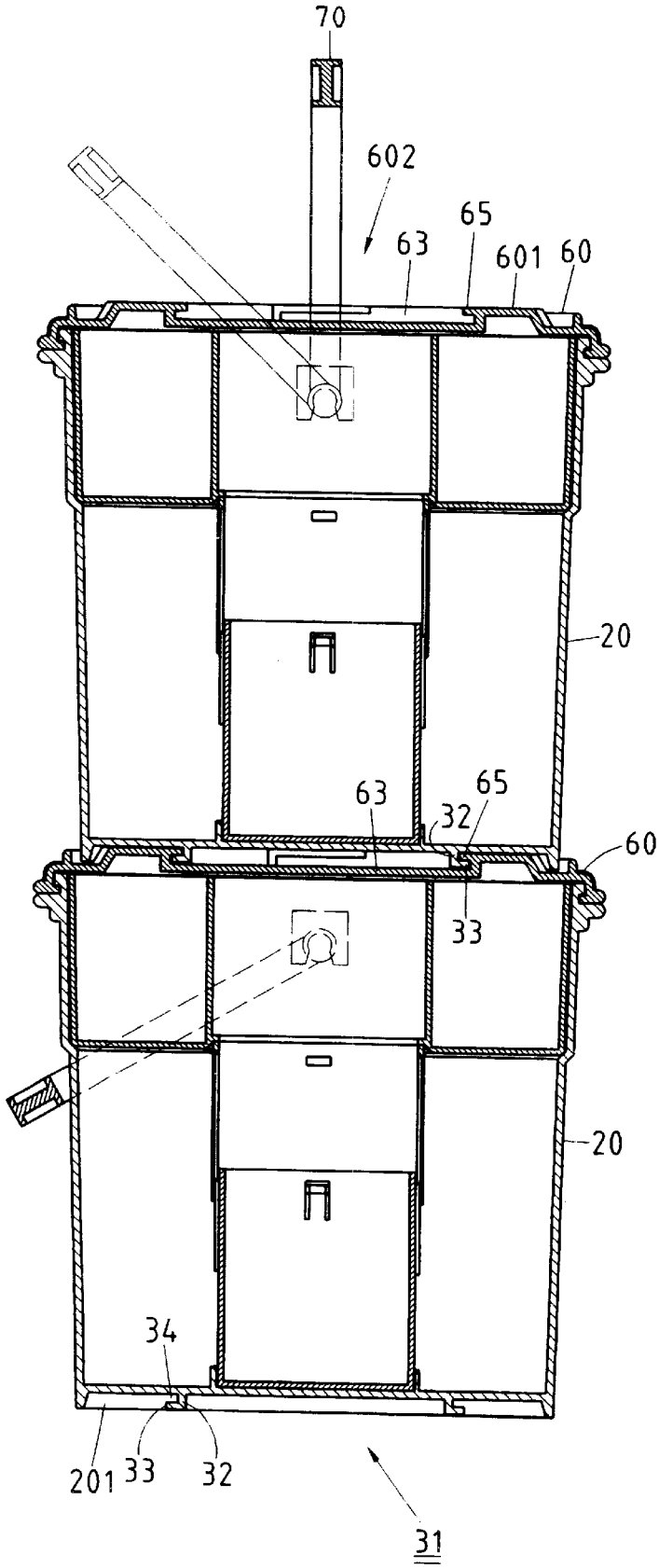
FIG. 6 shows a longitudinal sectional view of two baskets of the present invention which are fitted together end to end.
Figure 7:
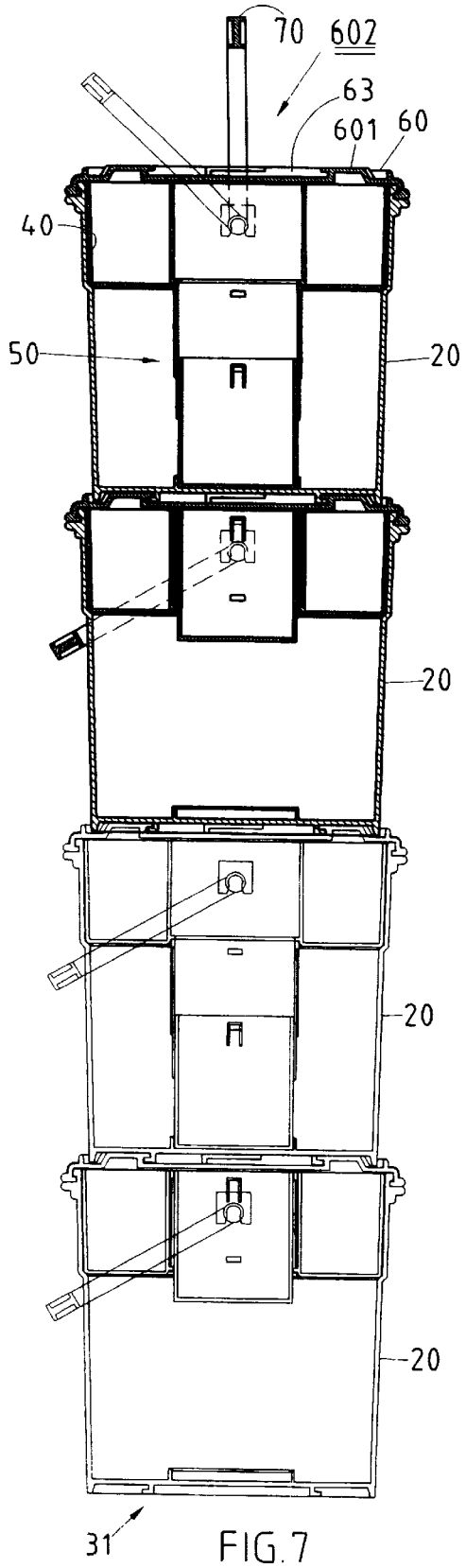
FIG. 7 shows a longitudinal sectional view of four baskets of the present invention which are fitted together end to end.
Figure 8:
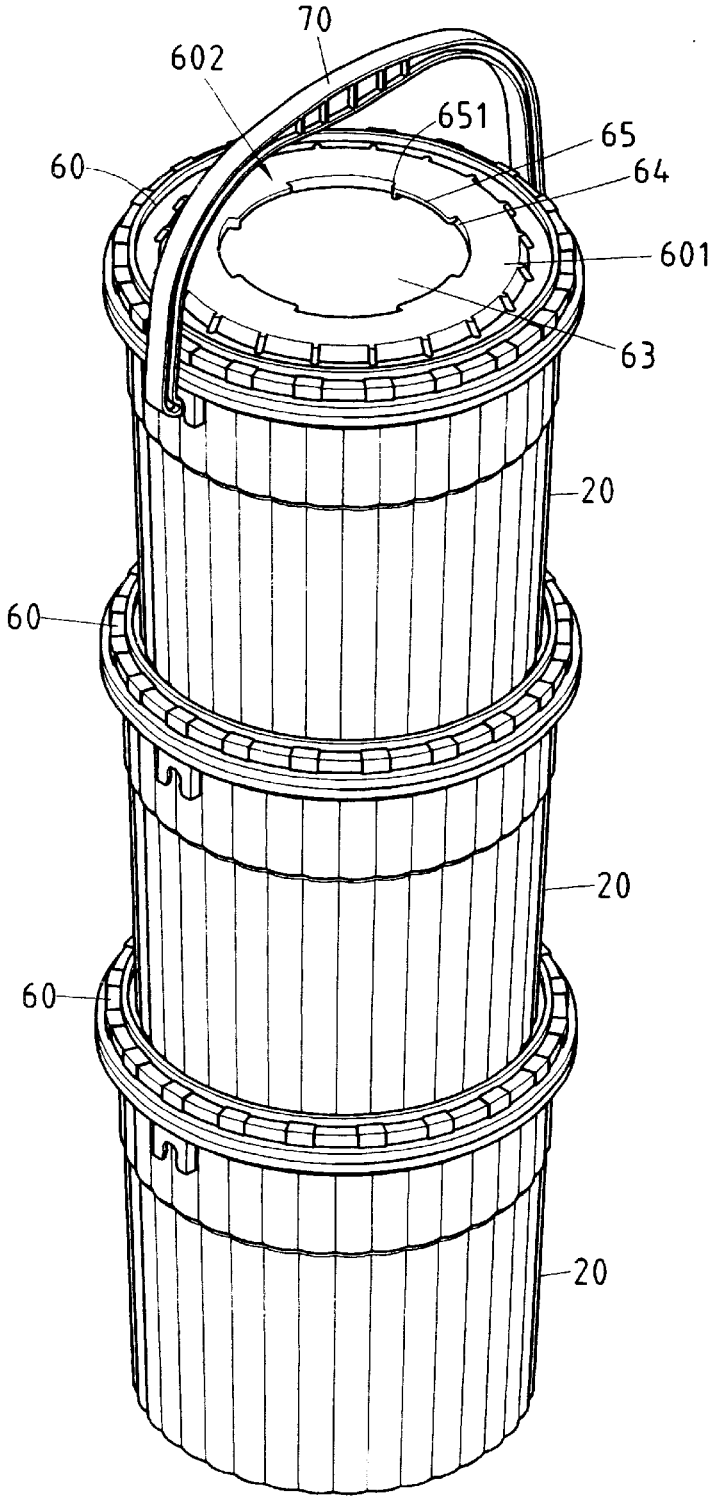
FIG. 8 shows a perspective view of three baskets of the present invention which are fitted together end to end.

As shown in FIGS. 6–8, the present invention is in fact provided with means to organize the articles held in the basket of the present invention. For example, the main body 20 can be used to accommodate the longer articles, whereas the cells 43 of the top box 40 and the interior of the expandable cylinder 50 can be used to hold smaller articles. In addition, the expandable cylinder 50 can be expanded to accommodate the longer articles. Furthermore, a plurality of the baskets of the present invention can be arranged together end to end such that the retaining portion 31 of the main body 20 of one basket is retained in the retaining portion 602 of the cover 60 of another basket.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An expandable basket for holding articles, said basket comprising:

a main body provided in a bottom thereof with an annular protrusion and an annular slot, and in an inner wall of a top portion thereof with an annular stop edge, and in an outer wall of the top portion thereof with an outer flange and an inner flange having a plurality of retaining strips separated from said outer flange by a space, with each of said retaining strips being provided at one end thereof with a stop body which is connected to said outer flange, said main body further provided in an outer wall thereof with two protuberances, with each having an opening;

a top box provided with a cylindrical body and a plurality of cells located between an outer wall of said cylindrical body and an inner wall of said top box whereby said top box is disposed in a top portion of said main body such that a bottom edge of said top box is stopped by said annular stop edge of said main body;

a cover provided in an outer periphery thereof with an annular wall which is provided with a plurality of retaining bodies whereby said cover is rotatably joined with said main body such that said retaining bodies of said cover are retained in said spaces of said main body; and a handle provided at both ends thereof with a retaining pillar and fastened at both ends thereof to said main body such that said retaining pillar of each of said both ends of said handle is retained in said opening of said two protuberances;

wherein said main body is provided in an underside thereof with a recess and a retaining portion having a bottom ring and a plurality of bottom strips, with each of said bottom strips being provided at one end thereof with an arresting body, which is connected with the underside of said main body;

wherein said cover is provided with an annular seat and a retaining portion and is further provided with a round slot and an inner wall whereby said inner wall is provided with a plurality of retaining edges and spaces, with each of said retaining edges being provided at one end thereof with a stop block, said stop block being connected with an underside of said round slot.

2.The expandable basket as defined in claim 1, wherein said retaining portion of said main body is engageable with said round slot of said retaining portion of said cover such that said bottom strips of said retaining portion are retained in said spaces of said cover.

3.The expandable basket as defined in claim 1, wherein said cylindrical body is further provided in an inner wall of a bottom portion thereof with an annular body to accommodate an expandable cylinder, said expandable cylinder being formed of an outer cylinder and an inner cylinder, with said outer cylinder being received in said cylindrical body such that an outer wall of said outer cylinder is in contact with an inner wall of said cylindrical body, said outer cylinder being provided in an inner wall thereof with two longitudinal slots, said outer cylinder further provided with an upper retaining hole and a lower retaining hole, said inner cylinder provided with a closed bottom, two longitudinally-oriented guide strips, and two elastic retaining hooks, said inner cylinder being received in said outer cylinder such that said guide strips of said inner cylinder are received in said longitudinal slots of said outer cylinder whereby said inner cylinder is slidably disposed in said outer cylinder such that said elastic retaining hooks of said inner cylinder are engageable with said upper retaining hole and said lower retaining hole of said outer cylinder.

* * * * *